US006049048A

United States Patent [19]

Ohira

[11] Patent Number: 6,049,048

[45] Date of Patent: Apr. 11, 2000

[54] JOGGLE SWITCH

[75] Inventor: Yutaka Ohira, Osaka, Japan

[73] Assignee: Funai Electric Co., Ltd., Osaka, Japan

[21] Appl. No.: 09/328,483

[22] Filed: Jun. 9, 1999

[30] Foreign Application Priority Data

Jun. 10, 1998 [JP] Japan ..... 10-4113

[51] Int. Cl.[7] ..... H01H 21/80

[52] U.S. Cl. ..... 200/339

[58] Field of Search ..... 200/4, 5 R, 6 R, 200/11 A–11 TW, 6 B–6 C, 16 R, 553, 557–559, 564, 568, 569, 572, 573, 574, 336, 339, 17 R, 18

[56] References Cited

U.S. PATENT DOCUMENTS 4,038,504 7/1977 McAnulty et al. ..... 200/11 DA
4,052,582 10/1977 Mullen et al. ..... 200/330
4,539,444 9/1985 Senoh ..... 200/5 R
5,794,766 8/1998 Morita et al. ..... 200/569
5,819,597 10/1998 Sato et al. ..... 74/553

*Primary Examiner*—Michael Friedhofer
*Attorney, Agent, or Firm*—Evenson, McKeown, Edwards & Lenahan, PLLC

[57] ABSTRACT

In order to rotatably support a joggle knob on a front panel, a recess is formed in the part of the front panel where the joggle knob is supported, and cuts are formed along the periphery of the recess in such a manner that they are coaxial with the center of turn. Furthermore, the joggle knob has locking pawls whose end portions are wedge-shaped in section. The locking pawls are inserted into the cuts, respectively. In addition, on the side of the inner surface of the front panel, sloped boards are arranged which have sloped surfaces along the loci of turn of the locking pawls. Hence, when the joggle knob is turned, the locking pawl is moved on the sloped board to push the latter backwardly, whereby a tact switch is positively pushed which is arranged behind the front panel.

6 Claims, 12 Drawing Sheets

JOGGLE SWITCH

BACKGROUND OF THE INVENTION

1. Field of the Invention

This invention relates to a joggle switch, and more particularly to a joggle switch which is turned on a video deck and the like.

2. Description of the Related Art

Conventionally, some of the joggle switches utilized in a video deck and the like are so designed as to be turned. In general, in the case of a video deck, a front panel is employed in addition to a body casing which serves as a chassis, and several operating elements are provided on the front panel. In the case of arranging a rotary operating element on the front panel, heretofore, a joggle switch is employed. More specifically, while the rotary operating element is arranged on the front panel, a joggle switch for detecting the rotation of the rotary operating element is arranged thereon.

A joggle switch proposed recently is designed as follows: The inner surface of the front panel includes a sloped surface. Furthermore, the joggle switch includes a sloped board. When the sloped surface abuts against the sloped board, the latter, while being pushed towards the rear surface, performs the on-off operation of a push switch arranged on the rear surface.

The above-described conventional joggle switches suffer from the following problems:

In the case of the former, for the rotary operating element, it is necessary to arrange the switch directly on the front panel. On the other hand, in the case of a push-type operating element, wiring is eliminated because, with the push switch arranged on the body casing, only the operating element can be arranged on the front panel. Hence, wiring work on the front panel is required for the rotary operating element only. Therefore, the manufacturing process is rather intricate.

In the case of the latter, it is possible to manufacture the joggle switch which has the rotary operating element, and is free from wiring work. However, when the joggle switch is turned to perform the on-off operation of the push switch arranged on the rear surface of the sloped board, the sloped surface is caused to move on the sloped board, so that the push switch is held stopped while being pushed down; that is, it becomes impossible to perform the on-off operation of the joggle switch.

SUMMARY OF THE INVENTION

In view of the foregoing, an object of the invention is to provide a joggle switch which has a rotary operating element, and is free from wiring work, and whose on-off operation is achieved positively.

In order to achieve the above object, according to the invention, there is provided a joggle switch which rotatably supports a joggle knob on a front panel, and, as the joggle knob is turned, pushes a push switch provided on an operating panel board, the joggle switch comprising: sector-shaped cuts which are formed in the part of the front panel where the joggle knob is supported in such a manner that the cuts are coaxial with a center of turn thereof, the joggle knob being locked with locking pawls inserted into the cuts whose end portions are wedge-shaped in section; sloped boards of elastic material which are provided on an inner surface side of the front panel, are arranged substantially at the center and along the loci of turn of the locking pawls, and have sloped surfaces which abut against the locking pawls in correspondence to positions of turn, the sloped boards being cantilevered, and being pushed backwardly when the locking pawls abut against the sloped surfaces; and push switches which are arranged on the operating panel board and on a rear side of the other end portions of the sloped boards.

In the joggle switch constructed as described above, the sector-shaped cuts are formed in the part of the front panel where the joggle knob is supported in such a manner that the cuts are coaxial with the center of turn of the joggle knob, and the joggle knob is locked with the locking pawls inserted into the cuts each of which has an end portion wedge-shaped in section. On the other hand, on the inner surface side of the front panel, the sloped boards, while being cantilevered, are provided along the loci of turn of the locking pawls which are moved as the joggle knob turns. When, depending on the location of turn of the joggle knob, the locking pawl is abutted against the sloped surface which is located approximately at the middle of the sloped board, then the sloped board is pushed backwardly. As a result, the push switch on the operating board is pushed which is arranged on the rear side of the other end of the sloped board.

The term "front panel" as herein used means a panel on which the rotary operating element, namely, the joggle knob is arranged; that is, it is not always necessary that the front panel is the front panel of the whole device; that is, it may be the front panel of a part of the device. The rotary operating element, namely, the joggle knob may be anything which can be turned, and it is not particularly limited in shape, and its turn is in a predetermined range of angle.

DETAILED DESCRIPTION OF THE PREFERRED EMBODIMENT

A joggle switch, which constitutes a preferred embodiment of the invention, will be described with reference to the accompanying drawings.

Figure 1:
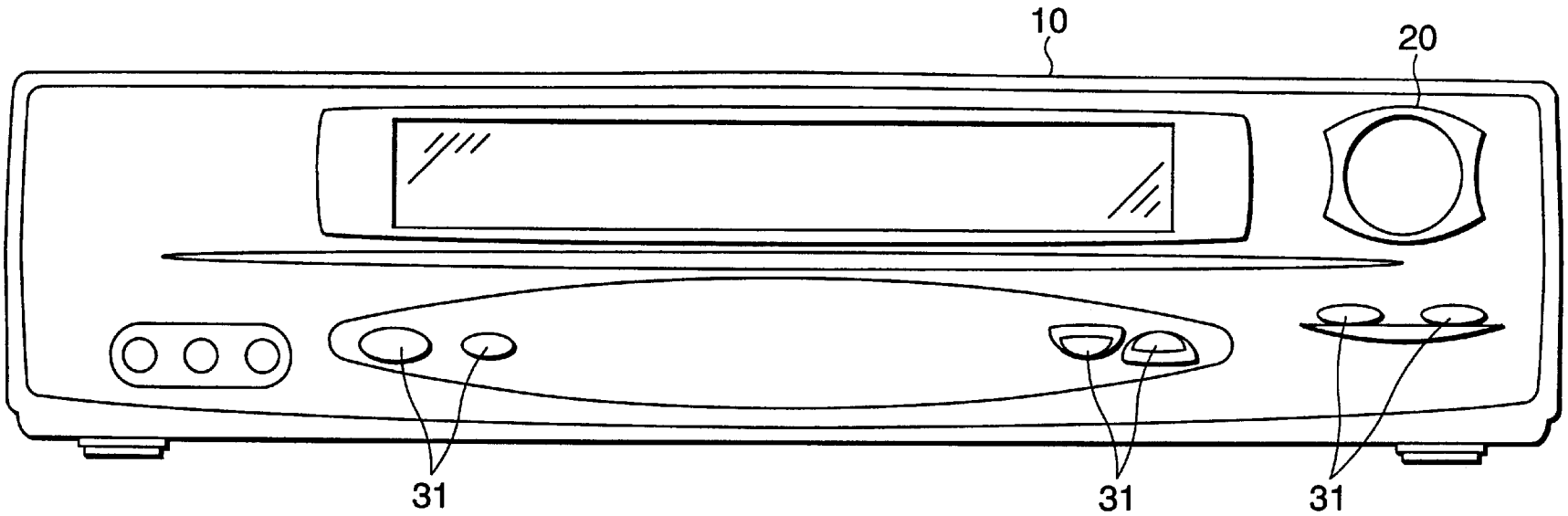
FIG. 1 is a front view of a video deck employing a joggle switch, which is a preferred embodiment of the invention.

FIG. 1 is a front view of a video deck to which the joggle switch is applied.

As shown in FIG. 1, a joggle knob 20 is mounted on the upper right part of the front surface of a front panel 10, and below the joggle knob 20 two push type operating elements 31 and 31 are provided horizontally. In addition, some push type operating elements 31 are provided on the front panel. The front panel 10 is so set as to cover the front of a body casing (not shown) which is located behind the drawing (FIG. 1). The front panel 10 has a variety of operating elements, while push switches and the like which require wiring are all provided on the body casing. The swing operation of the joggle knob 20 on the front panel 10, and the push operation of the push type operating elements 31 are converted into forward and backward operations to turn on and off the push switches on the body casing.

Figure 2:
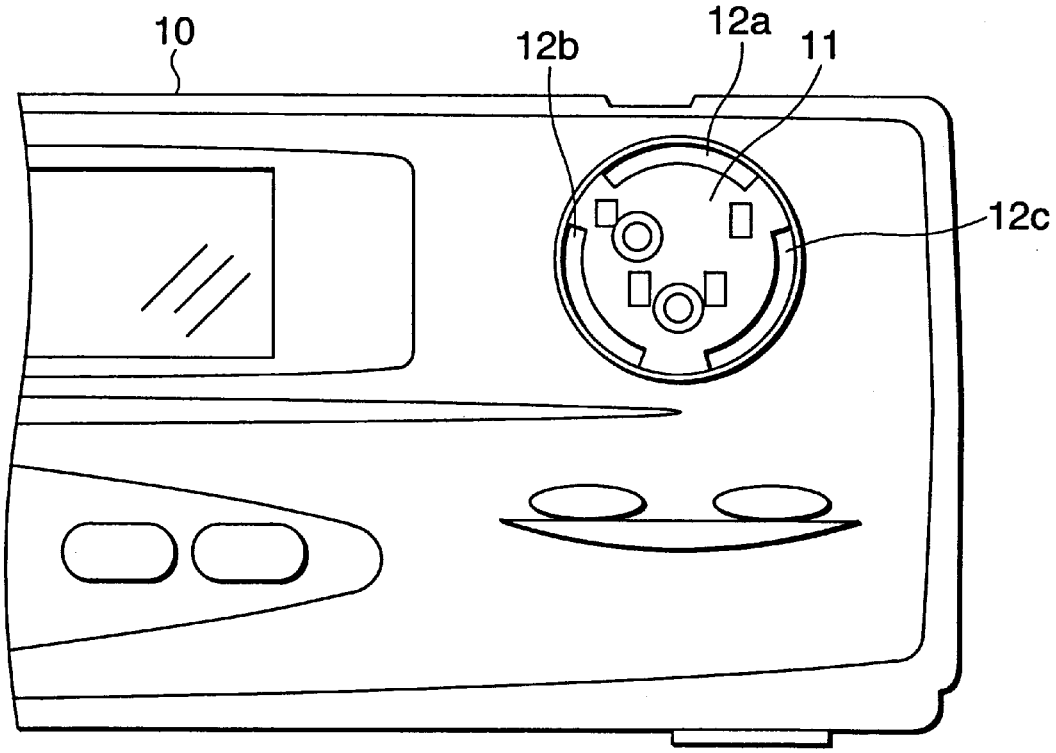
FIG. 2 is a front view of a front panel of the video deck.
Figure 3:
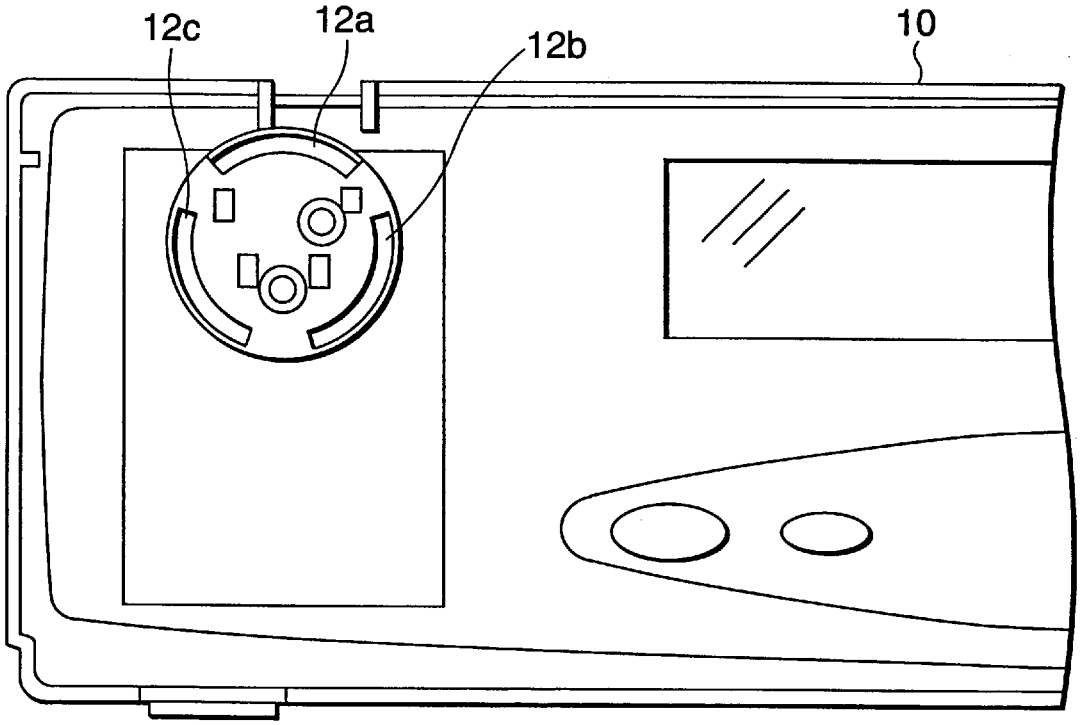
FIG. 3 is a rear view of the front panel of the video deck.

In the embodiment, the technical concept of the invention is applied to a stationary type video deck; however, it goes without saying that the technical concept of the invention is applicable to other electrical equipments. FIG. 2 shows the position of the joggle knob 20 on the front panel. The joggle knob 20 has a circular recess 11, and arcuate cuts 12*a,* 12*b* and 12*c* along the circumference of the circular recess 11. The arcuate cuts 12*a,* 12*b* and 12*c* are separate from one another, and are arranged at equal angular intervals. As is seen from a rear view of FIG. 3, those cuts 12*a* through 12*c* penetrate the front panel 10.

Figure 4:
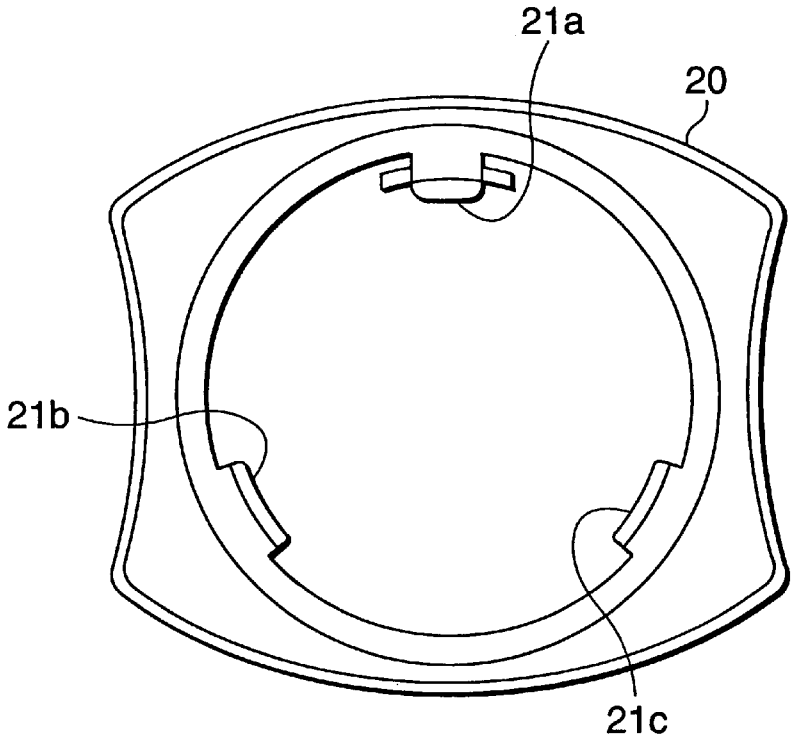
FIG. 4 is a front view of a joggle knob.
Figure 5:
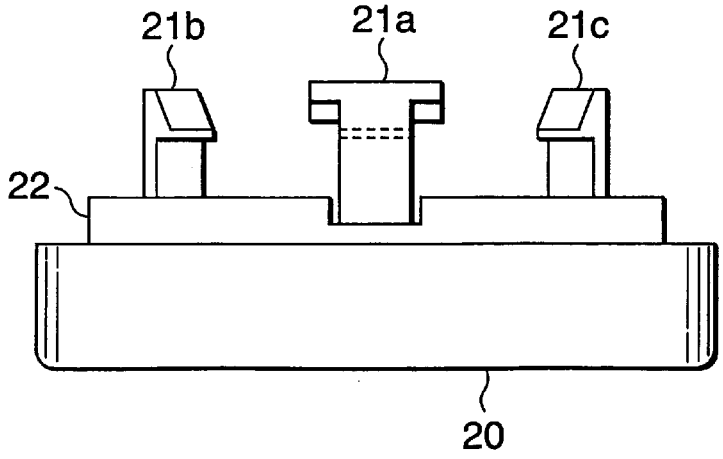
FIG. 5 is a plan view of the joggle knob.

As shown in FIGS. 4 and 5, the joggle knob 20 is substantially cylindrical, and has three locking pawls 21*a,* 21*b* and 21*c* on the rear surface which are arranged substantially at equal angular intervals. Those locking pawls 21 are formed in correspondence to the cuts 12*a* through 12*c* of the front panel 10. The joggle knob 20 has a cylindrical barrel 22. As the barrel 22 is inserted into the aforementioned recess 11, the locking pawls 21*a* through 21*c* are engaged with the cuts 12*a* through 12*c,* respectively. The locking pawls 21*a* through 21*c* have wedge-shaped pawls at the ends which are protruded inwardly. In this engaging operation, the aforementioned wedge-shaped pawls move over the inner peripheries of the cuts 12*a* through 12*c,* thus being locked to the wall surface. The locking pawls 21*a* through 21*c* are smaller in width than the cuts 12*a* through 12*c.* Therefore, the joggle knob 20 is snugly supported on the front panel 10, and may be turned to an extent that the locking pawls 21*a* through 21*c* slide in the cuts 12*a* through 12*c.* More specifically, the angle of turn of the locking pawls is a predetermined value on each of the right and left sides.

In the embodiment, the three locking pawls 21 are engaged with the three cuts 12 to support the joggle knob 20. However, it may be possible to engage two or more than three pawls are engaged with two or more than three cuts, respectively.. However, the operation by the joggle knob 20 is merely the right or left swing operation, and therefore the combination of the three locking pawls 21 and the three cuts 12 provides a swing range suitable for the joggle knob. In addition, the above-described combination snugly supports the joggle knob on the front panel; that is, the joggle knob is supported thereon stably with no play. Furthermore in the above-described embodiment, the locking pawls 21 are formed along the inner peripheries of the cuts; however, they may be formed along the outer peripheries of the cuts.

Figure 6:
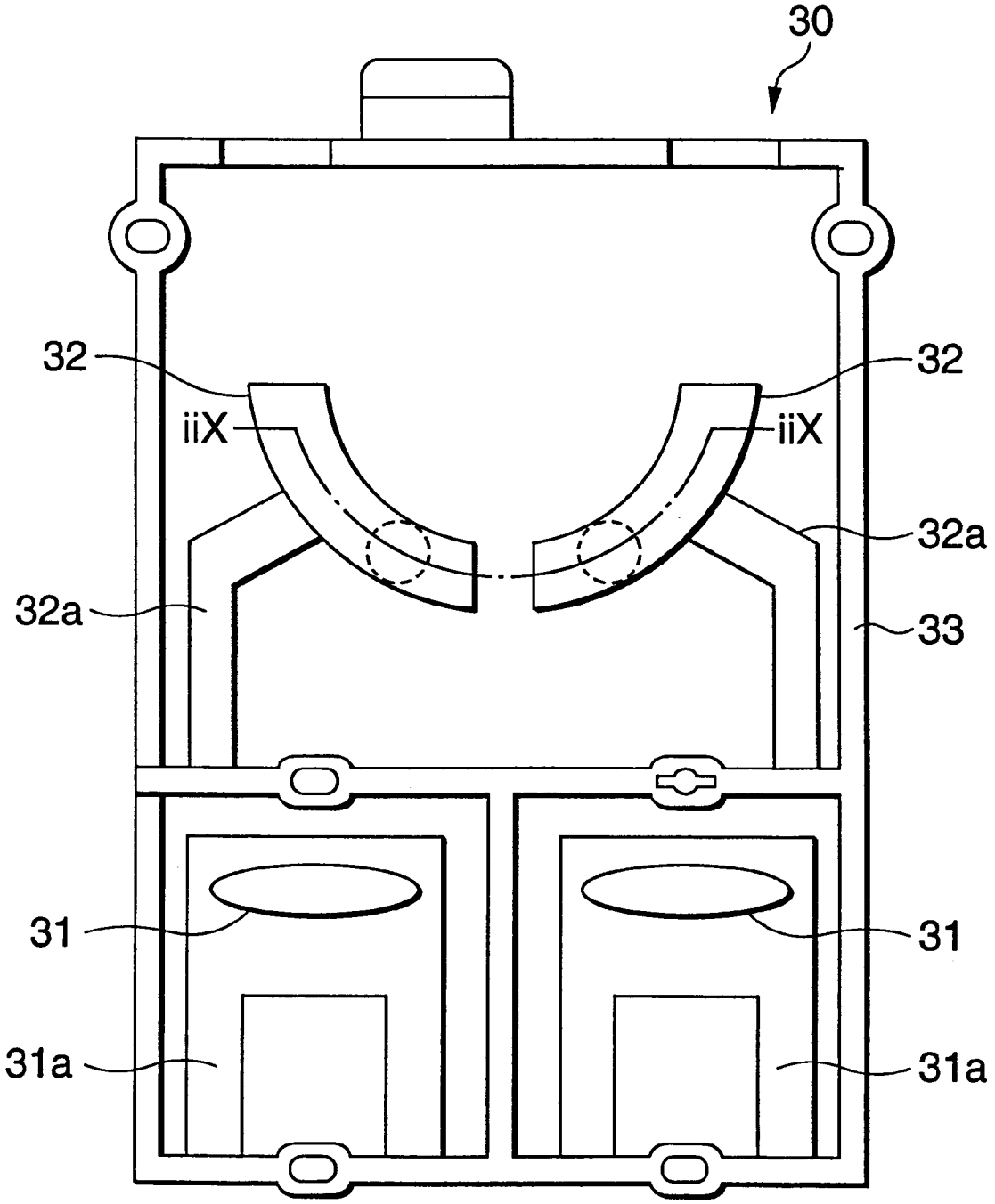
FIG. 6 is a front view of an intermediate plate.
Figure 7:
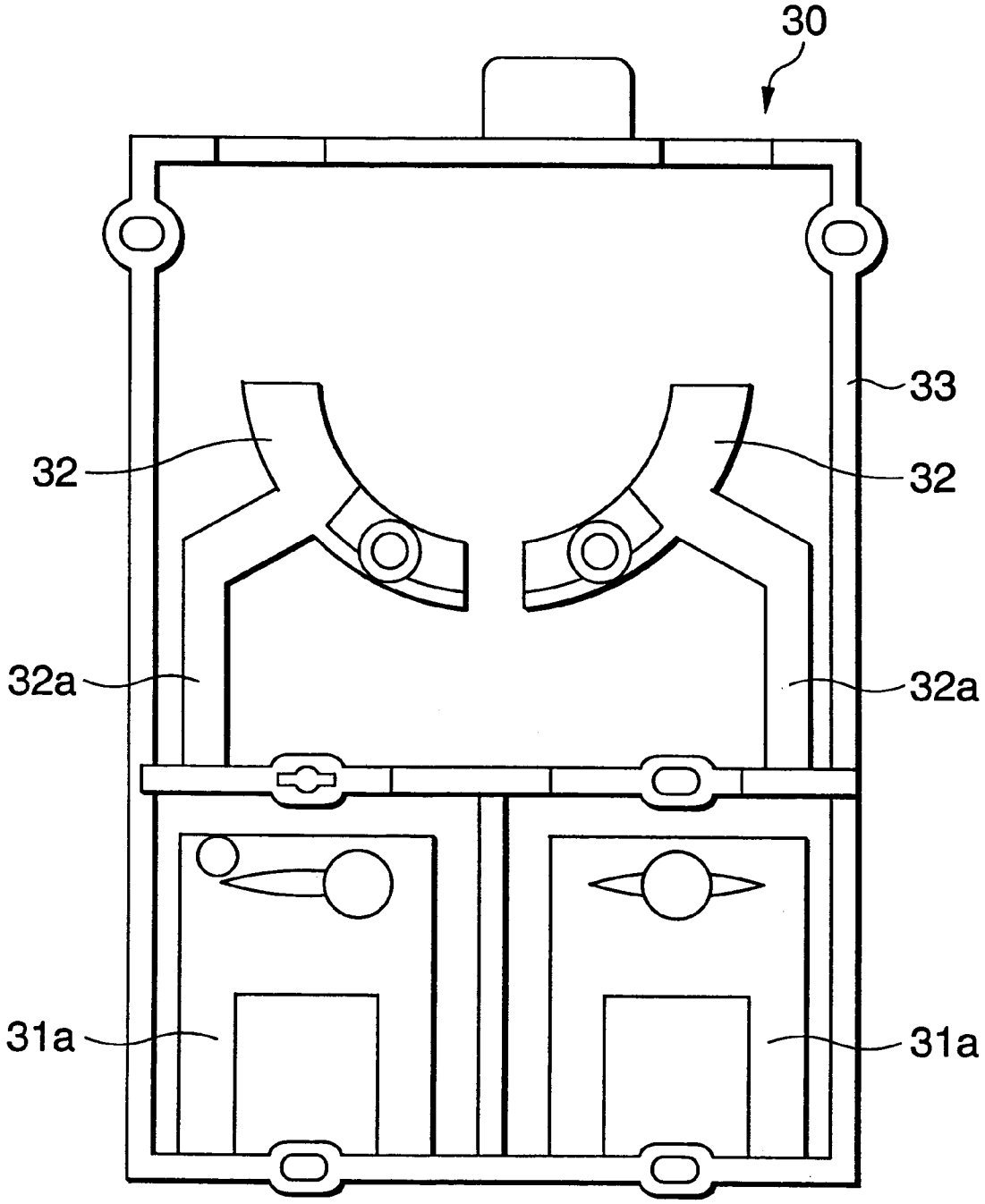
FIG. 7 is a rear view of the intermediate plate.

On the inner surface of the front panel 10, an intermediate panel 30 (whose front and rear surfaces are as shown in FIGS. 6 and 7, respectively) is provided. The intermediate panel 30 is arranged in correspondence to the loci of turn of the locking pawls 21*b* and 21*c*. The aforementioned push type operating elements 31 and 31 are supported in a frame 33 through thin-plate-shaped elastic pieces 31*a* and 32*a.* In this connection, it goes without saying that the sloped boards 32 and 32 and the push type operating elements 31 and 31, being coupled to the frame 33 through the elastic pieces 31*a* and 32*a,* is bendable forwardly and backwardly in a predetermined range.

Figure 8:
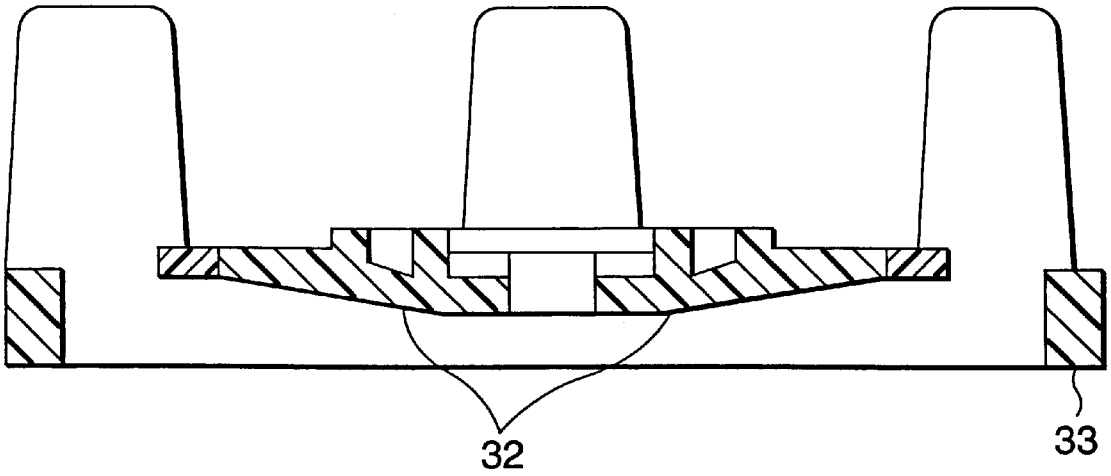
FIG. 8 is a sectional view taken along line iix—iix in FIG. 6.
Figure 11:
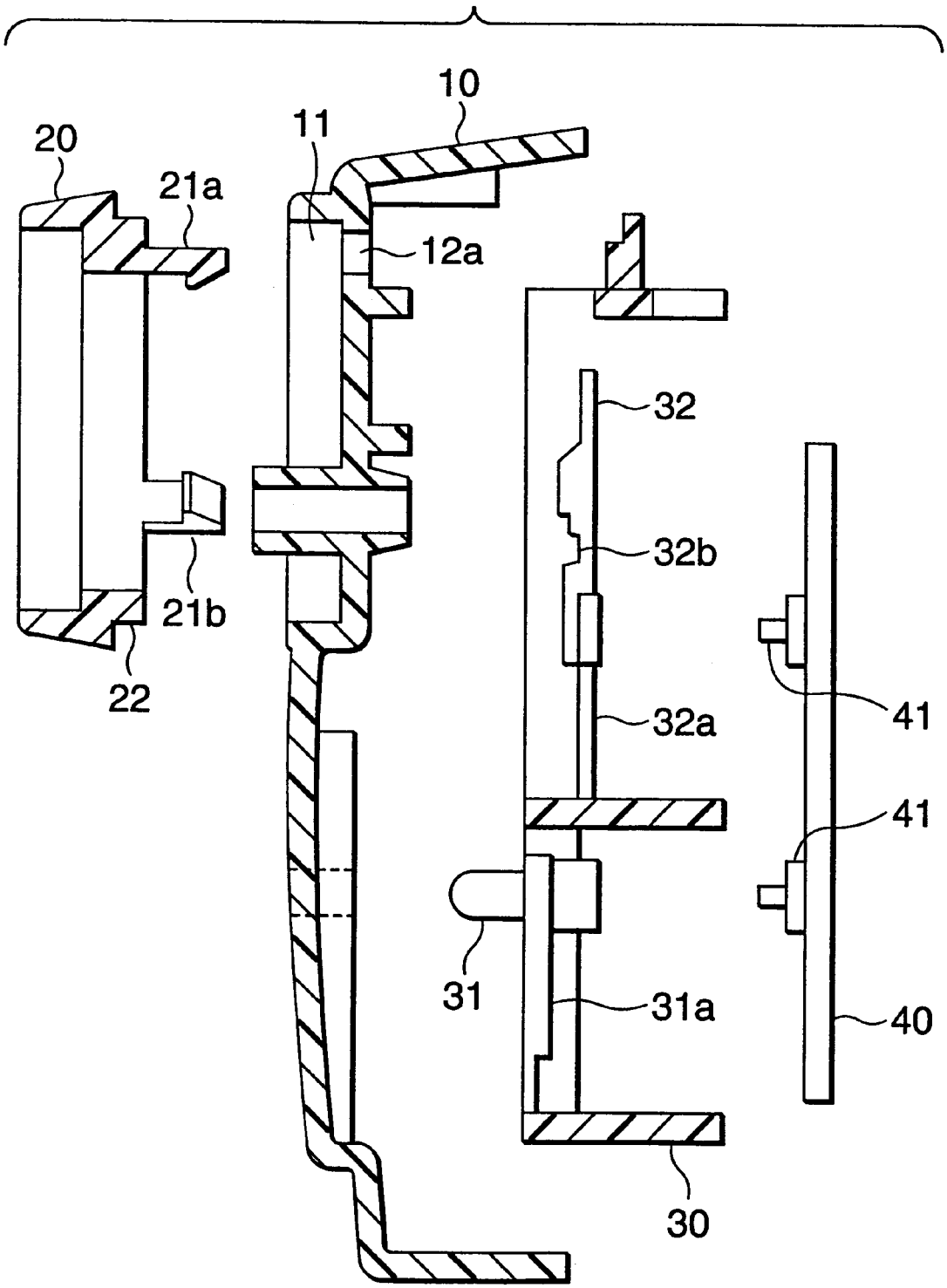
FIG. 11 is a sectional view for a description of the positional relationships between the joggle knob, the front panel, the intermediate panel, and an operating panel.

FIG. 8 is a sectional view taken along line iix—iix in FIG. 6. The sloped boards 32 and 32 are formed along the loci of swing of the locking pawls 21*b* and 21*c*. Each of the sloped boards has a sloped surface at the middle which projects forwardly. Accordingly, when the joggle knob 20 installed is turned right and left, the locking pawls 21*b* and 21*c* are selectively abutted against the respective sloped boards 32 and 32, so that one of the sloped boards 32 is pushed backwardly (towards the rear surface side). On the rear surface side, an operating panel board 40 is arranged as shown in FIG. 11. On the operating panel board 40, tact switches 41 are arranged which are each a kind of push switch.

As shown in FIG. 11, the sloped boards 32 and 32 have bend portions 32*b* below the sloped surfaces. When the tact switches 41 are pushed a predetermined distance as was described above, the bend portions are bent in the opposite direction. The predetermined distance is a value with which the tact switch 41 is positively depressed to achieve the on-off operation thereof, and is such that a suitable load is applied to the tact switch 41.

Figure 9:
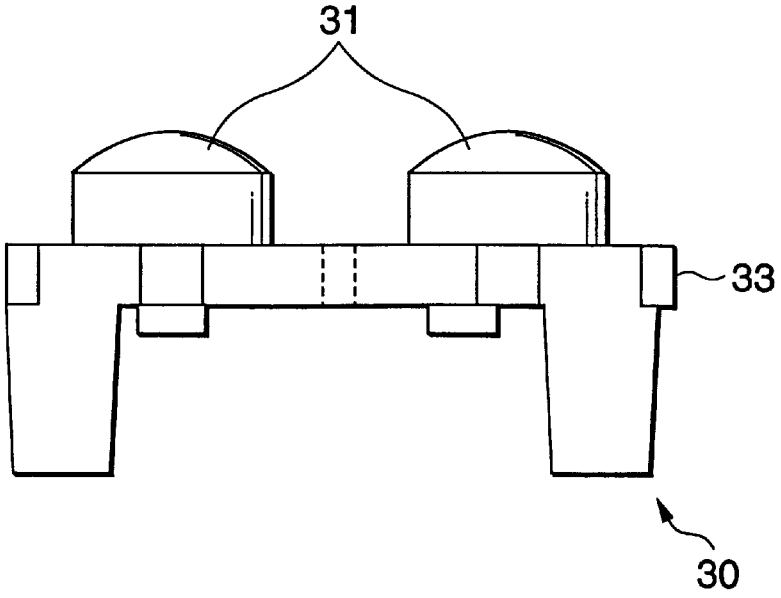
FIG. 9 is plan view of the intermediate plate.

FIG. 9 is a plan view of the intermediate panel 30. In FIG. 9, the push-type operating elements 31 and 31 are protruded forwardly. Those operating elements 31 and 31 are so arranged as to protrude forwardly through the front panel 10. Behind the push-type operating elements, the tact switches 41 are arranged on the operation panel board 40.

In the embodiment, the sloped boards 32 and the push-type operating elements 31 are simultaneously formed on the intermediate panel 30: however, it is not always necessary to do so. If, on the intermediate panel 30 supporting the push-type operating elements 31, the sloped boards 32 are simultaneously formed, then it is unnecessary to form the push-type operating elements and the sloped boards at different times, which simplifies the manufacturing work as much.

Figure 10:
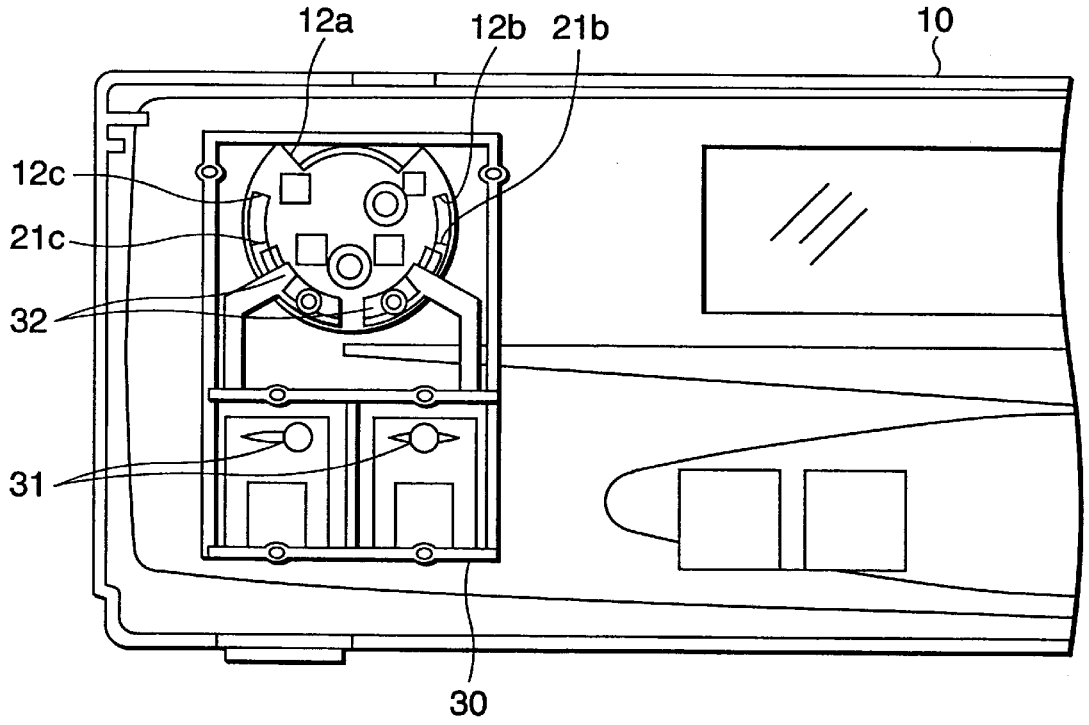
FIG. 10 is a rear view of the front panel which has been assembled.

FIG. 10 shows the joggle knob 20 mounted on the front surface of the front panel 10, and the intermediate panel 30 mounted on the rear surface side thereof. FIG. 11 shows the positional relationships between the joggle knob 20, the front panel 10, the intermediate panel 30, and the tact switches 41 on the operating panel board 40 located on the rear surface side thereof. When, after those components have been assembled, the sloped board 32 is pushed backwardly, the upper tact switch 41 is pushed; and when the push-type operating element 31 is pushed backwardly, the lower tact switch 41 is pushed.

The operating panel board 40 together with various boards is secured to the body casing (not shown). When the front panel 10 is secured to the body casing, the sloped boards 32, the push-type operating elements 31 and the like are confronted with the tact switches 41 arranged in place.

In the embodiment, the push switches are the tact switches 41; however, the latter may be replaced with other types of switches. In addition, it is not always necessary to secure the operating panel board 40 to the body casing; that is, it may be such that, at least, a plurality of push switches are arranged in separation from the assembling operation of the front panel 10, and are integrally mounted on the front panel 10. This is because, even in this case, it is unnecessary to arrange the switches directly on the joggle knob 20.

Now, the operation of the embodiment thus designed will be described.

Figure 12A:
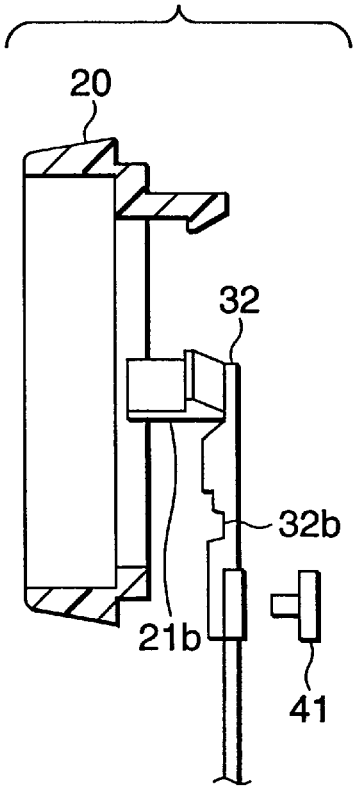
FIGS. 12(*a*) and 12(*b*) are explanatory diagrams for a description of the positional relationships between the joggle knob, a sloped board, and a tact switch at the time of non-turn operation.
Figure 12B:
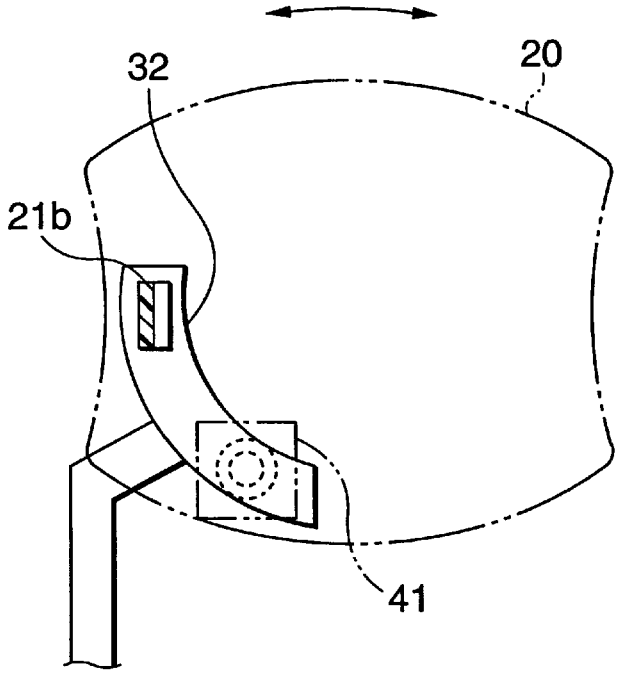

On the side of the body casing, a manufacturing step of fixing the operating panel board 40 has been accomplished, while on the side of the front panel 10, a manufacturing step of mounting the joggle knob 20 on the front surface and mounting the intermediate panel 30 on the rear surface has been accomplished. When, under this condition, the front panel 10 is fixed, the locking pawls 21*b* (21*c*) of the joggle knob 20, the sloped board 32, and the tact switch 41 are positioned in such a manner that, as shown in FIGS. 12(*a*) and 12(*b*), they are horizontally in contact with one another. As conducive to an understanding of the essential elements, FIGS. 12(*a*) and 12(*b*) show a sectional view and a front view of those elements.

As shown in the drawings, when the joggle knob 20 is located above the middle, the locking pawl 21*b* is in abutment with the flat surface of the upper end portion of the sloped board 32. Hence, the sloped board 32 is located at the front part of the movable range, and is spaced a little distance from the tact switch 41 located behind it.

Figure 13:
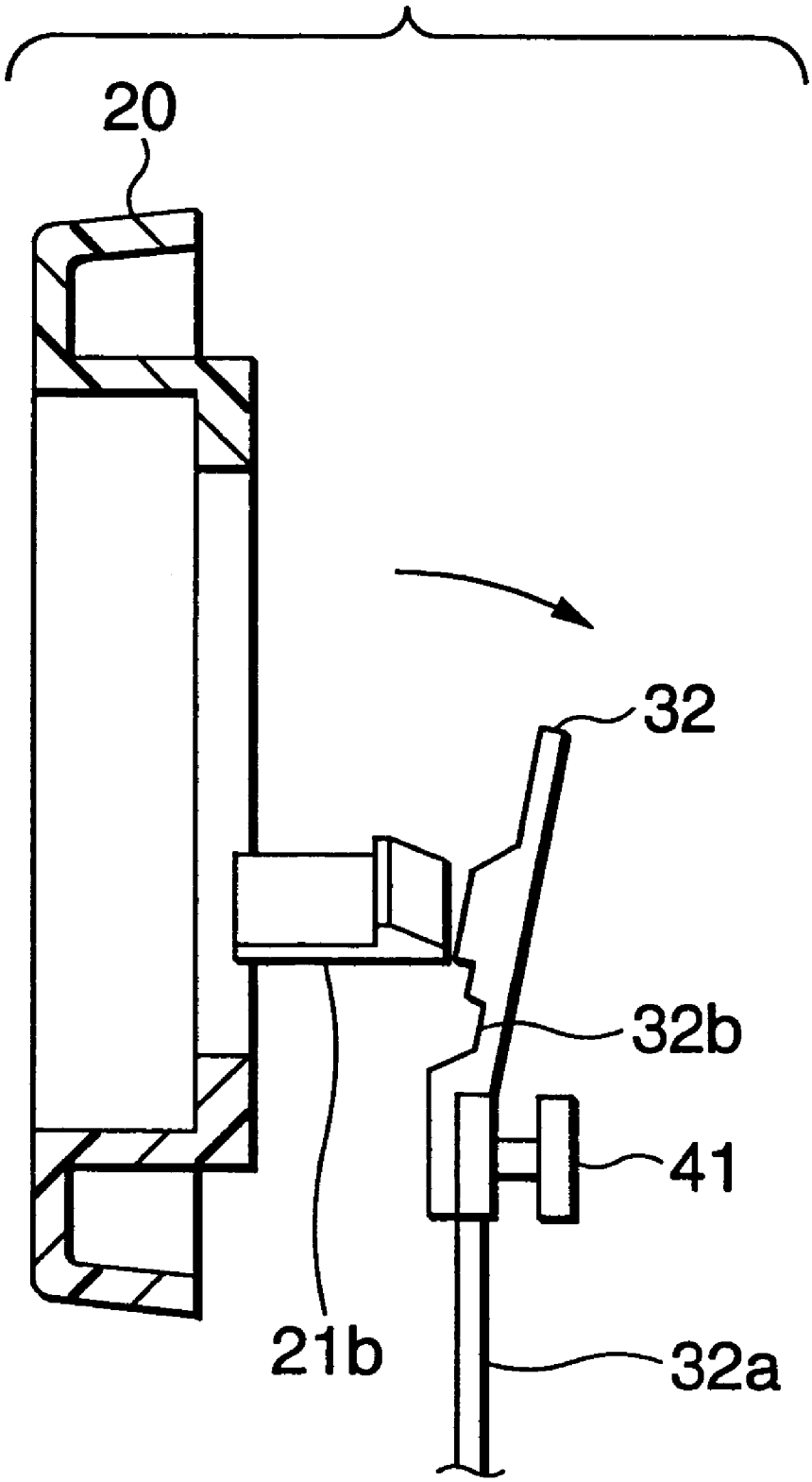
FIG. 13 is an explanatory diagram for a description of the positional relationships between the joggle knob, the sloped board, and the tact switch at the time of turn operation.

When the joggle knob 20 is turned counterclockwise, the locking pawl 21*b* is moved while drawing an arc, and moves on the sloped surface of the sloped board 32. The locking pawl 21*b* is locked while clinging the front panel 10, so that it cannot be moved forwardly. As a result, as shown in FIG. 13, the sloped board 32 is pushed backwardly. Accordingly, the tact switch 41, which is located below and behind the sloped board 32, is pushed backwardly; that is, the tact switch 41 can be turned on and off.

When, in this case, the tact switch 41 is pushed a predetermined distance, the sloped board 32 is bent, with the bend portion 32*b* as a fulcrum, in the direction opposite to the direction in which the tact switch 41 is pushed; that is, an external force applied to the tact switch 41 is reduced as much.

In the case when the joggle knob 20 is turned clockwise, the other locking pawl 21*c* pushes the other sloped board 32, so that the other tact switch 41 located on the rear surface side is pushed backwardly.

The ends of the lock pawls 21*b* and 21*c* may be so formed to have sloped surfaces so that, when the joggle knob is turned, they are brought into contact with the tact switches 41. However, it is obvious that the locking pawls 21 are locked in such a manner that they are swingable while penetrating the cuts 12 of the front panel 10, and therefore it is not practical to form them into large ones. Accordingly, the locking pawls 21 are unavoidably small. However, since the locking pawls are small, then the positioning of them with respect to the tact switches 41 becomes difficult, and accordingly the casing must be high in dimensional accuracy. This results in an increase in manufacturing cost, and makes the manufacturing process intricate. On the other hand, in the case where the sloped board 32 is arranged along the locus of turn, it is unnecessary to increase the assembling accuracy; that is, the joggle switch can be manufactured with ease.

On the body casing side, the operation of the push-type operating elements 31 and the operation of turn of the joggle knob are of push-type. This is advantageous in the following point: The same operating panel board 40 as the operating panel board of the model having push-type operating elements or the model having turning elements can be used, as it is, to form the joggle switch. A so-called "surface replacing operation" can be achieved with ease.

Figure 14:
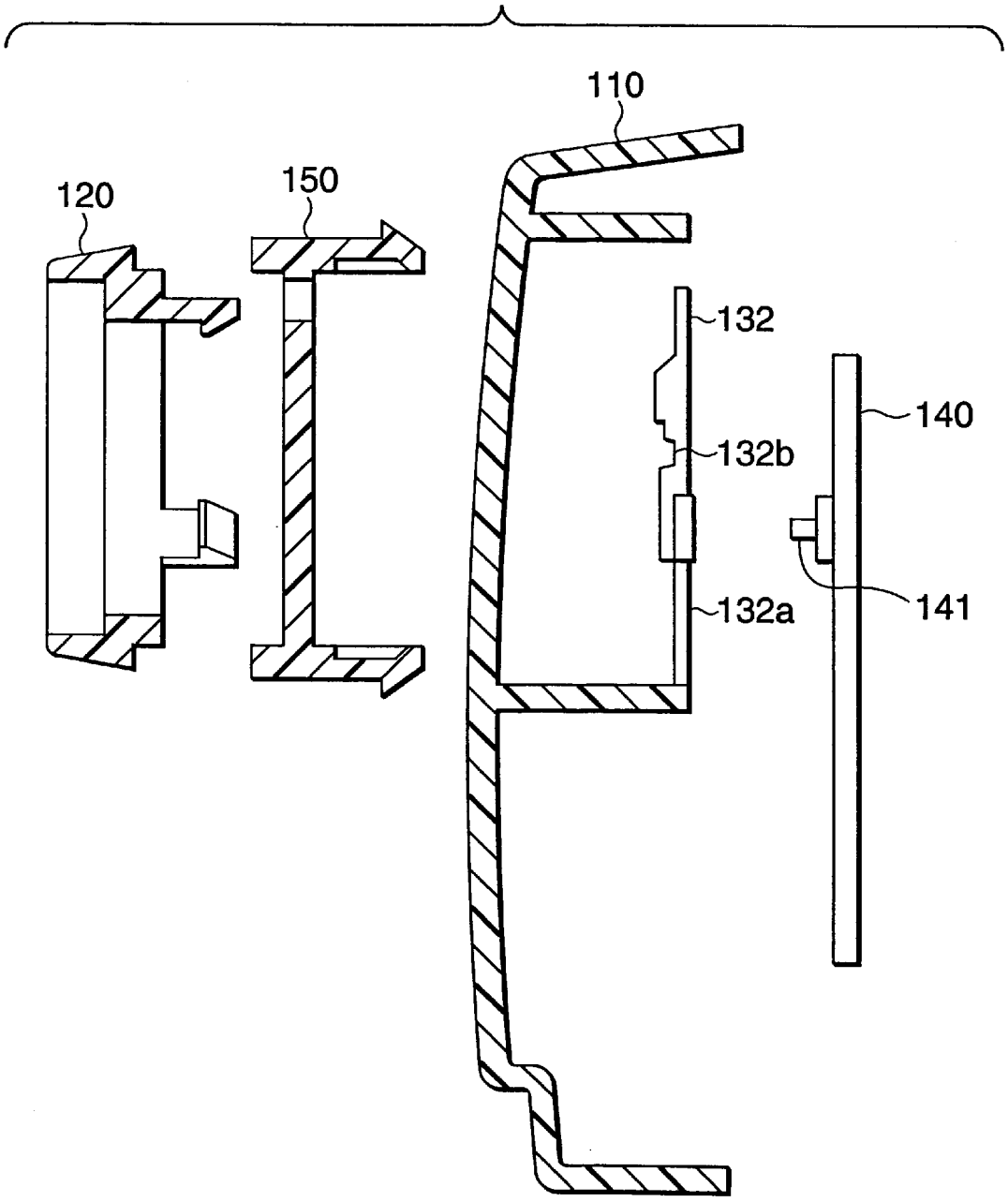
FIG. 14 is a sectional view for a description of the positional relationships between a joggle knob, a front panel, an intermediate panel, and an operating panel board in a modification of the embodiment.

FIG. 14 shows a modification of the above-described embodiment of the invention. In the video deck shown in FIG. 14, a sloped board 132 has a bend portion 132*b* and is integral with a front panel 110. In addition, a supporting board member 150 is engaged with the front panel 110 from the front side, and a joggle knob 120 is mounted on the supporting board member 150. In the employment of the push-type operating element, there is a case where the front panel 110 has an elastic piece, and the push-type operating element is formed with an additional (different) member. In this case, the joggle knob 120 is supported with the supporting board member 150 which is the additional member, to realize the present invention.

Also in this case, although the rotary operating element, namely, the joggle knob 120 is employed, it is unnecessary to arrange the switch directly on the front panel 110, and it is possible to push the tact switch 141 on the operating panel board 140 which is held on the body casing.

If summarized, in order to rotatably support the joggle knob 20 on the front panel 10, the recess 11 is formed in the part of the front panel 10 where the joggle knob 20 is supported, and the cuts 12*a* through 12*c* are formed along the periphery of the recess 11 in such a manner that they are coaxial with the center of rotation. Furthermore, the joggle knob 20 has the locking pawls 21*a* through 21*c* each of which is wedge-shaped in section, and those locking pawls are inserted into the cuts 12*a* through 12*c*, respectively, so as to be locked. In addition, on the side of the inner surface of the front panel 10, the sloped board 32 is arranged which have the sloped surfaces along the loci of turn of the locking pawls 21*a* through 21*c*. Hence, when the joggle knob 20 is turned, the aforementioned locking pawls 21 are moved on the sloped board 32 to push the latter backwardly, so that the tact switches 41 are positively pushed which are provided on the operating panel board 40 which is provided on the rear side of the front panel 10. When the tact switch is pushed the predetermined distance, the bend portion 32*b* bends the sloped board, which reduces the load as much which is applied to the tact switch 41.

As was described above, according to the invention, the joggle switch is provided which is such that, in the case of arranging the rotary operating element, namely, the joggle knob, it is unnecessary to arrange the switch directly on the front panel, and accordingly its wiring work is eliminated, and the on-off operation of the joggle switch is positively achieved.

Only the locking pawls and the cuts function to prevent the rotary operating support from coming off the front panel and to turn the rotary operating element. Therefore, the locking pawls penetrating the front panel are limited in size. However, in the invention, since the sloped boards are employed, the sloped boards are each indirectly driven to push the push switches. Hence, the sloped boards are not limited in size. This feature makes it possible to positively push the push switch, and eliminates the occurrence of errors in operation.

What is claimed is:

1. A joggle switch which rotatably supports a joggle knob on a front panel, and, as said joggle knob is turned, pushes push switches provided on an operating panel board, said joggle switch comprising:

sector-shaped cuts which are formed in a part of said front panel where said joggle knob is supported in such a manner that said cuts are coaxial with a center of turn thereof, said joggle knob being locked with locking pawls inserted into said cuts whose end portions are wedge-shaped in section;

sloped boards of elastic material which are provided on an inner surface side of said front panel, are arranged substantially at a center and along a loci of turn of said locking pawls, and have sloped surfaces at one of two end portions which abut against said locking pawls in correspondence to positions of turn, said sloped boards being cantilevered, and being pushed backwardly when said locking pawls abut against said sloped surfaces; and said push switches are arranged on said operating panel board and on a rear side of the other end portions of said sloped boards.

2. The joggle switch as claimed in claim 1, wherein said sloped boards include bend portions which, when said locking pawls, abutting against said sloped surfaces, are pushed backwardly to push said push switches, are bent opposed to said push switches.

3. The joggle switch as claimed in claim 1, wherein the number of said cuts is three and the number of said locking pawls is also three, and said cuts and said locking pawls are arranged substantially at equal angular intervals.

4. The joggle switch as claimed in claim 1, wherein said joggle knob is turnable right and left, and said sloped boards are arranged in respective ranges of turn in correspondence to two of said locking pawls.

5. The joggle switch as claimed in claim 1, wherein each of said sloped boards has a push operating element at a part thereof which is protruded from said front panel, and said sloped surface at another part thereof.

6. The joggle switch as claimed in claim 1, wherein said sloped boards are formed on said front panel, and said front panel supports said joggle knob through a supporting board.

* * * * *